US008132438B2

(12) United States Patent
Mishima

(10) Patent No.: US 8,132,438 B2
(45) Date of Patent: Mar. 13, 2012

(54) CLOSING METHOD AND CLOSING MACHINE

(75) Inventor: Keisuke Mishima, Tokyo (JP)

(73) Assignee: Kayaba Industry Co, Ltd., Tokyo (JP)

( * ) Notice: Subject to any disclaimer, the term of this patent is extended or adjusted under 35 U.S.C. 154(b) by 790 days.

(21) Appl. No.: 11/887,203

(22) PCT Filed: Mar. 30, 2006

(86) PCT No.: PCT/JP2006/307264

§ 371 (c)(1),
(2), (4) Date: Sep. 26, 2007

(87) PCT Pub. No.: WO2006/107085

PCT Pub. Date: Oct. 12, 2006

(65) Prior Publication Data

US 2009/0078015 A1 Mar. 26, 2009

(30) Foreign Application Priority Data

Mar. 31, 2005 (JP) ..... 2005-101557

(51) Int. Cl.
*B21D 41/04* (2006.01)

(52) U.S. Cl. ..... 72/38; 72/69; 72/370.12

(58) Field of Classification Search ..... 72/370.12, 72/69, 84, 38, 18.3, 19.1, 17.2, 18.1, 17.3, 72/18.2, 342.1, 364, 80–82, 124, 125; 34/380, 34/382, 427, 437, 440; 374/141, 142; 73/865.9
See application file for complete search history.

(56) References Cited

U.S. PATENT DOCUMENTS

| | | | | |
|---|---|---|---|---|
| 4,719,791 | A * | 1/1988 | Greiner et al. | 72/38 |
| 5,237,844 | A * | 8/1993 | Duri | 72/19.1 |
| 5,718,139 | A * | 2/1998 | Gardner | 72/38 |
| 5,845,527 | A * | 12/1998 | Hoffmann et al. | 72/69 |
| 6,742,236 | B1 | 6/2004 | Dion et al. | |
| 7,022,932 | B2 | 4/2006 | Hatakeyama et al. | |
| 2003/0154600 | A1 | 8/2003 | Umeda et al. | |
| 2003/0217592 | A1 * | 11/2003 | Nagaike et al. | 73/104 |
| 2004/0045778 | A1 | 3/2004 | Hatakeyama et al. | |

FOREIGN PATENT DOCUMENTS

| | | |
|---|---|---|
| JP | 2002-153930 | 5/2002 |
| JP | 2002-192277 | 7/2002 |
| JP | 2002-331537 | 11/2002 |
| JP | 2003-509181 | 3/2003 |
| JP | 2003-200241 | 7/2003 |
| JP | 2005-502876 | 1/2005 |
| JP | 2005-342725 | 12/2005 |

* cited by examiner

*Primary Examiner* — Dana Ross
*Assistant Examiner* — Pradeep C Battula
(74) *Attorney, Agent, or Firm* — Rabin & Berdo, PC

(57) ABSTRACT

A closing machine (1) for closing a rotating work piece (9) by pressing a heated die (4) against the work piece (9) comprises an air purge box (510) which opens onto the vicinity of the work piece (9), air supply means for supplying air to the air purge box (510), and a sensor (501, 502) provided in the interior of the air purge box (510) to detect a state of the work piece (9) or the die (4).

2 Claims, 5 Drawing Sheets

CLOSING METHOD AND CLOSING MACHINE

FIELD OF THE INVENTION

This invention relates to an improvement in a closing method and a closing machine for closing an open end of a metal pipe material.

BACKGROUND OF THE INVENTION

In a closing method, a work piece constituted by a metal pipe material is rotated and a die is pressed against the work piece while the work piece is heated. Thus, the work piece undergoes plastic deformation as it gradually approaches the die.

A closing machine used in the closing operation comprises an outer diameter chuck that holds an outer peripheral surface of the work piece, and a chuck spindle that drives the outer diameter chuck to rotate together with the work piece. The work piece is closed by pressing the rotating die against the work piece at an offset to the rotating work piece.

The closing method and closing machine are disclosed in JP2002-153930A.

In a conventional closing machine, a sensor for detecting the position of the work piece and a sensor for detecting the temperature of the die are provided near the processed portion of the work piece, and the closing operation is performed automatically in accordance with detection signals from these sensors.

However, in a conventional closing machine, lampblack is generated from the processed portion of the work piece when the die and work piece are heated, and this lampblack may soil the lens and so on of the sensors, leading to a reduction in the detection precision of the sensors.

It is therefore an object of this invention to provide a closing method and a closing machine with which the detection precision of a sensor can be maintained.

SUMMARY OF THE INVENTION

This invention provides a closing method for closing an open end of a work piece that rotates about an axial center thereof by pressing a heated die against the work piece, characterized by providing an air purge box which opens onto a vicinity of the work piece, supplying air to an interior of the air purge box, and detecting a state of the work piece or the die by a sensor provided in the interior of the air purge box.

Further, this invention provides a closing machine for closing an open end of a work piece that rotates about an axial center thereof by pressing a heated die against the work piece, characterized by an air purge box which opens onto a vicinity of the work piece, air supply mechanism for supplying air to an interior of the air purge box, and a sensor provided in the interior of the air purge box to detect a state of the work piece or the die.

According to this invention, during a closing operation in which the die is pressed against the rotating work piece while the work piece is heated such that the work piece is subjected to plastic deformation as it approaches the die, the interior of the air purge box is filled with the air that is supplied thereto, and the air flows out to the exterior of the air purge box through the opening portion, thereby suppressing the infiltration of lampblack generated from a processed portion of the work piece into the air purge box. As a result, the detection portion of the sensor can be prevented from becoming soiled by the lampblack, whereby the detection precision of the sensor can be maintained at a high level.

DESCRIPTION OF THE PREFERRED EMBODIMENTS

This invention will now be described in further detail with reference to the attached drawings.

Figure 1:
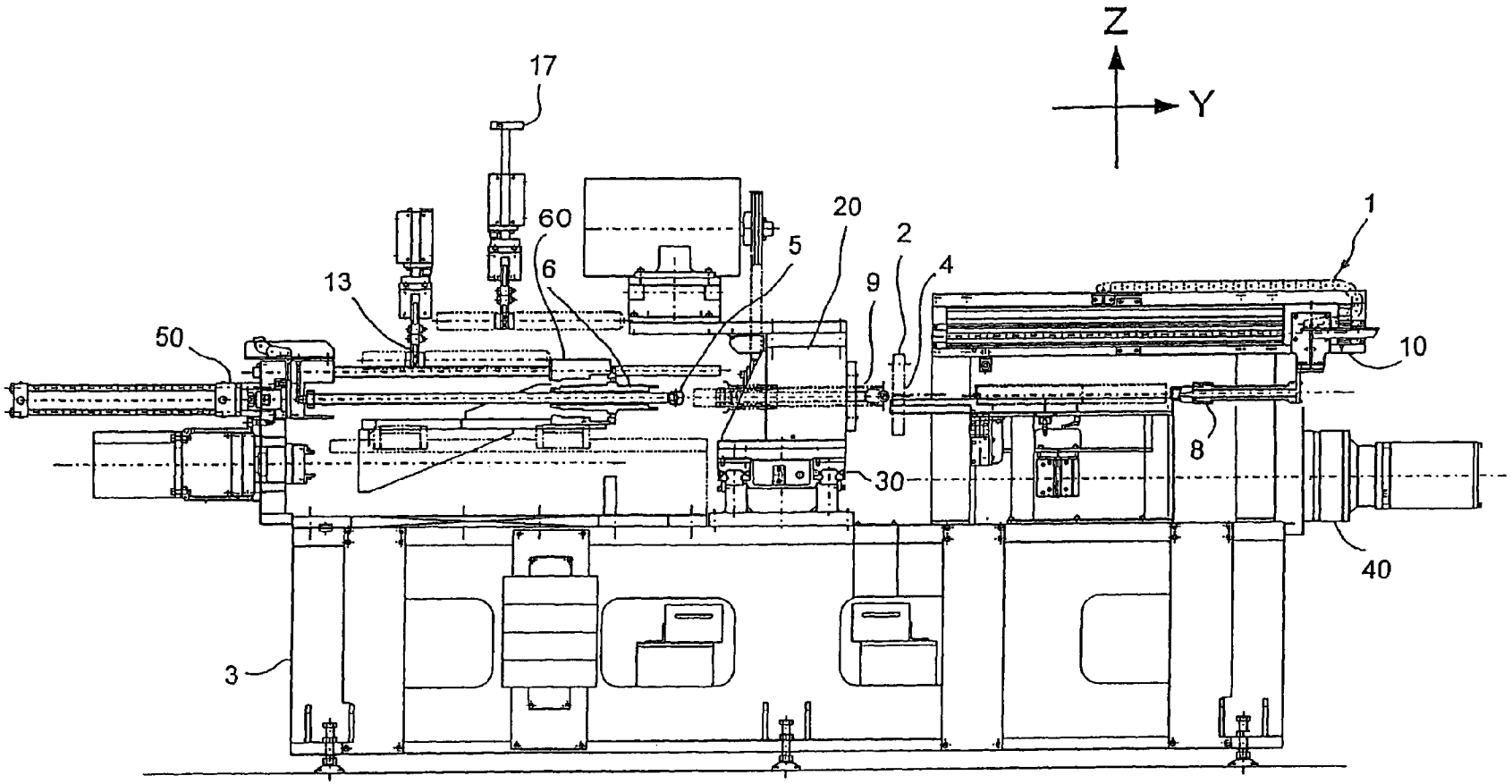
FIG. 1 is a side view of a closing machine, illustrating an embodiment of this invention.
Figure 2:
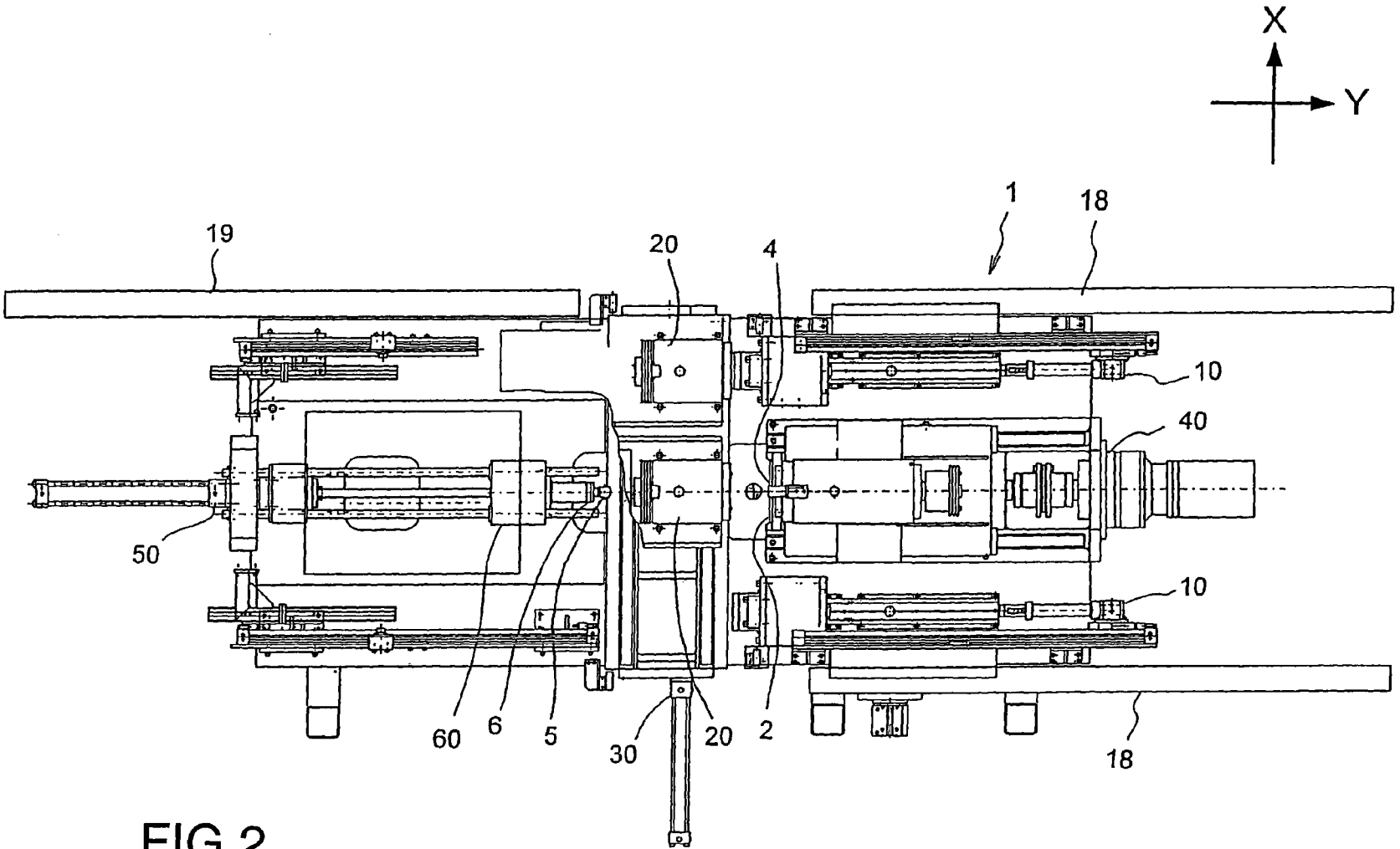
FIG. 2 is a plan view of the closing machine.
Figure 3:
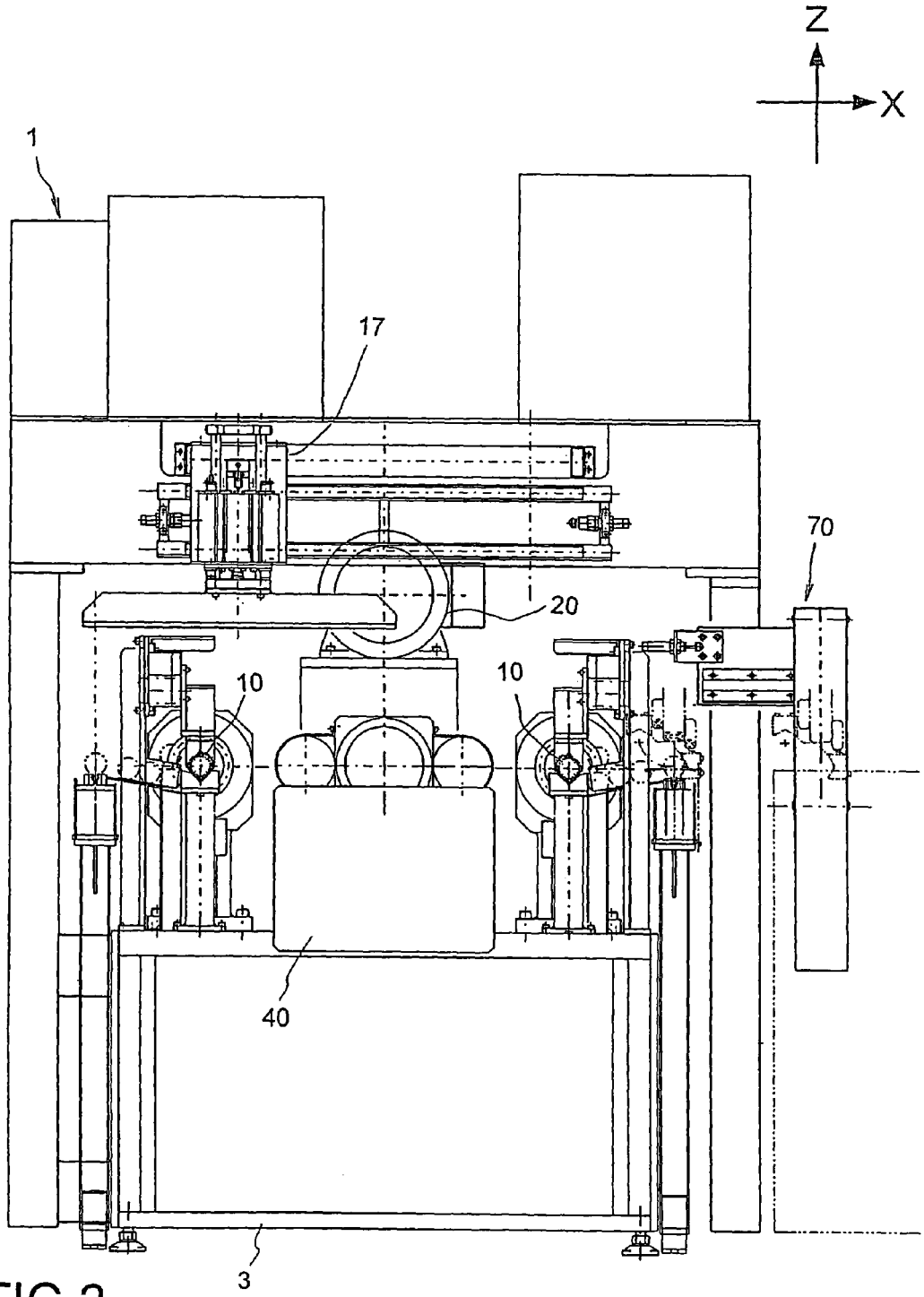
FIG. 3 is a front view of the closing machine.

FIGS. 1 to 3 show the overall constitution of a closing machine 1. In FIGS. 1 to 3, three axes, namely X, Y, and Z, are set orthogonal to each other. It is assumed that the X axis extends in a substantially horizontal lateral direction, the Y axis extends in a substantially horizontal front-rear direction, and the Z axis extends in a substantially vertical direction. The overall constitution of the closing machine 1 will now be described.

Two chuck spindles 20 which drive a work piece 9 to rotate about its axial center, and a single die driving device 40 which drives a die 4, are provided in a central portion of the closing machine 1. The chuck spindles 20 perform a reciprocating motion in the X axis direction relative to a pedestal 3 via a chuck spindle moving device 30, to be described later, thereby moving alternately to the central portion of the closing machine 1 so as to bring the work piece 9 face to face with the die 4.

The closing machine 1 performs a closing operation to close an open end of the work piece 9 by heating the work piece 9, which is constituted by a metal pipe material, using a high-frequency heating device 2, and pressing the die 4 against the rotating work piece 9 such that the work piece 9 undergoes plastic deformation.

A thrust stopper moving device 60, which is positioned in front of the chuck spindle 20 for closing the work piece 9 so as to support an end portion of the work piece 9, and a core moving device 50, which moves a core 5 inside the work piece 9, are provided in the central portion of the closing machine 1.

A pair of conveyors 18 and a work piece introducing device 10 are provided respectively on the left and right rear portions of the working machine 1. The work piece 9 is conveyed forward in the Y axis direction by each of the conveyors 18 and then conveyed forward in the Y axis direction by each of the work piece introducing devices 10, which are capable of movement in the Y axis direction. Thus, the work piece 9 is introduced into and gripped by the respective left and right chuck spindles 20.

While one of the chuck spindles 20 is positioned in the central portion of the working machine 1 during a closing operation, the other chuck spindle 20 is positioned on either the left or right end portion of the closing machine 1 so as to receive the work piece 9 conveyed by the respective work piece introducing devices 10.

A discharge device 17 for discharging the work piece 9 following the closing operation is provided at the front portion of the closing machine 1. The discharge device 17 causes a hand 13 gripping the work piece 9 to reciprocate in the X axis direction relative to the pedestal 3 such that the work piece 9, which is pushed out from the left and right chuck spindles 20, is conveyed to a conveyor 19 disposed on the right-hand front portion of the closing machine 1.

Once the closing operation is complete, the work piece 9, which is at a high temperature of 1000° C. or more, is conveyed to a cooling device 70 (see FIG. 3) by the conveyor 19 and cooled by the cooling device 70. The cooling device 70 is provided on the front right side of the closing machine 1.

FIGS. 4A to 4G show a series of processes performed by the closing machine 1 to close the work piece 9. Each process of this closing method will now be described in sequence.

Figure 4A:
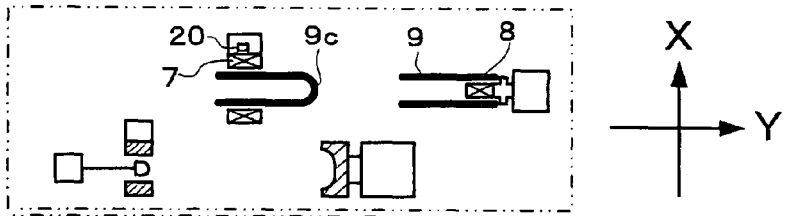
FIGS. 4A-4H are views showing closing processes.

Referring to FIG. 4A, an inner diameter chuck 8 of the work piece introducing device 10 is inserted into the work piece 9 such that the inner diameter chuck 8 grips the inner peripheral surface of the work piece 9.

Figure 4B:
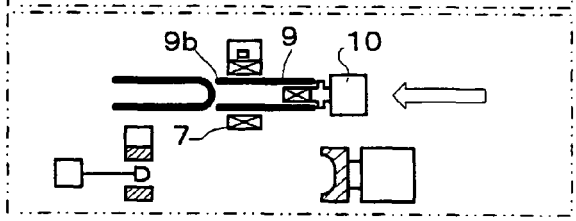

Referring to FIG. 4B, the work piece introducing device 10 causes the inner diameter chuck 8 to advance in the Y axis direction such that the work piece 9 is inserted into an outer diameter chuck 7 of the chuck spindle 20. Thus, the outer diameter chuck 7 grips the outer peripheral surface of the work piece 9.

Figure 4C:
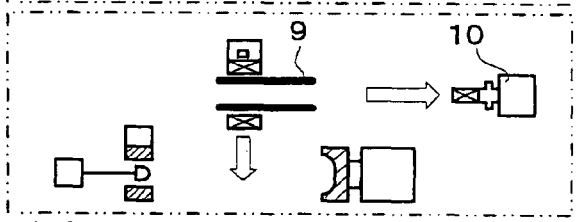

Referring to FIG. 4C, the work piece introducing device 10 causes the inner diameter chuck 8 to retreat in the Y axis direction such that the inner diameter chuck 8 is extracted from the work piece 9. Next, the chuck spindle moving device 30 moves the chuck spindle 20 in the X axis direction until the work piece 9 is stopped in an operation position facing the die 4.

Figure 4D:
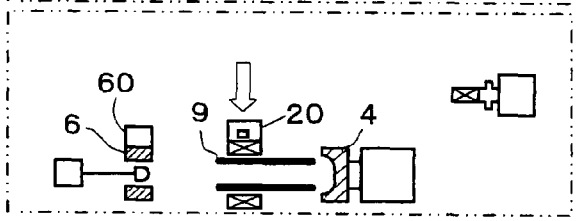

Referring to FIG. 4D, the thrust stopper moving device 60 moves a thrust stopper 6 to a thrust operation reference position supporting a base end portion 9*b* of the work piece 9.

Figure 4E:
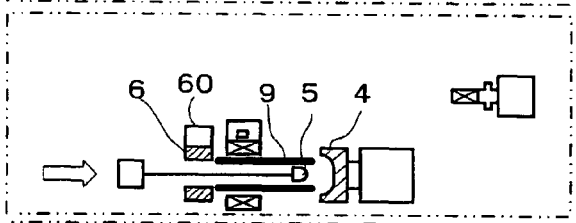

Referring to FIG. 4E, the core moving device 50 introduces the core 5 into the inside of the work piece 9.

Figure 4F:
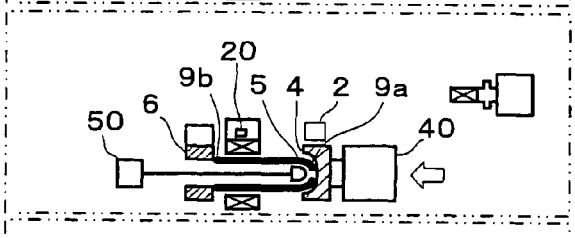

Referring to FIG. 4F, the chuck spindle 20 drives the work piece 9 and the core 5 to rotate. Meanwhile, the die 4 is pressed against the heated work piece 9 by the die driving device 40. Thus, a tip end portion 9*a* of the work piece 9 is steadily reduced in diameter between the die 4 and the core 5 such that finally, the tip end portion 9*a* of the work piece 9 closes to form a bottom portion 9*c*.

Figure 4G:
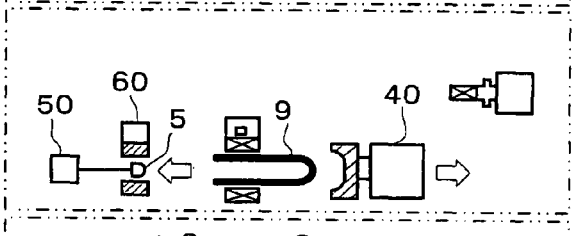

Referring to FIG. 4G, the die driving device 40 moves the die 4 rearward in the Y axis direction away from the work piece 9. Meanwhile, the thrust stopper moving device 60 moves the thrust stopper 6 forward in the Y axis direction away from the thrust operation reference position, and the core moving device 50 removes the core 5 from the inside of the work piece 9.

To close another work piece 9 thereafter, the chuck spindle moving device 30 moves the chuck spindle 20 in the X axis direction such that the work piece 9 faces the inner diameter chuck 8, as shown in FIG. 4A. Then, as shown in FIG. 4B, the work piece introducing device 10 causes the inner diameter chuck 8 to advance in the Y axis direction such that the base end portion 9*b* of the unclosed work piece 9 abuts against the bottom portion 9*c* of the closed work piece 9, and thus the closed work piece 9 is pushed out of the outer diameter chuck 7.

Figure 4H:
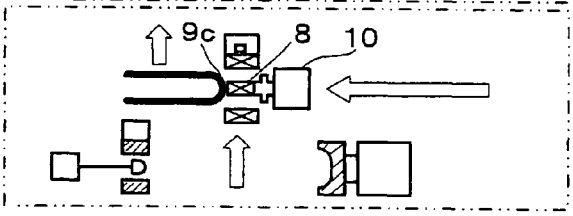

To terminate the closing operation of the work piece 9, the work piece introducing device 10 causes the inner diameter chuck 8 to advance in the Y axis direction, as shown in FIG. 4H, such that the inner diameter chuck 8 abuts against the bottom portion 9*c* of the closed work piece 9, and thus the closed work piece 9 is pushed out of the outer diameter chuck 7.

The overall constitution of the closing machine 1 was described above.

Next, the constitution of the die driving device 40 shown in FIG. 5 will be described.

The die driving device 40 comprises a die support shaft 41, the die 4 being attached to a front end portion thereof, a die support case 42 which supports the die support shaft 41 rotatably via a bearing not shown in the figure, two guide rails 44 which support a sliding table 43 carrying the die support case 42 movably in the Y axis direction, and a hydraulic cylinder which drives the sliding table 43 in the Y axis direction. The hydraulic cylinder moves the die support case 42 forward in the Y axis direction during a closing operation in accordance with the output of a controller, not shown in the figure, such that the die 4 is pressed against the work piece 9.

The die driving device 40 comprises the die support shaft 41 which supports the die 4 rotatably, a power transmission mechanism 401 which transmits the rotation of a motor 46 to the die support shaft 41, and a one-way clutch 410 which inputs torque from the power transmission mechanism 401 to the die support shaft 41 while blocking torque input from the die support shaft 41 to the power transmission mechanism 401.

The closing machine 1 comprises a position sensor 501 which detects the position of the work piece 9 relative to the die driving device 40 using laser beams. The controller controls the closing operation by activating the die driving device 40 in accordance with a detection signal from the position sensor 501.

The closing machine 1 comprises a temperature sensor 502 which detects the temperature of the die 4. The controller controls the closing operation in accordance with a detection signal from the temperature sensor 502.

During a closing operation, which is performed in a state where the die 4 and the work piece 9 are heated to 1000° C. or more, for example, by the high-frequency heating device 2, lampblack is generated from the processed portion of the work piece 9, and this lampblack may soil the lens and so on of the position sensor 501 and temperature sensor 502, leading to a reduction in the detection precision.

To prevent this problem, the closing machine 1 comprises an air purge box 510 which opens onto the vicinity of the work piece 9 when the work piece 9 is in a processing position, and an air pressure source 515 as air supply means for supplying air to the air purge box 510. The position sensor 501 and temperature sensor 502 for detecting the state of the work piece 9 or the die 4 are provided inside the air purge box 510 such that the position sensor 501 and temperature sensor 502 are not exposed to the lampblack that is generated from the processed portion of the work piece 9.

Figure 5:
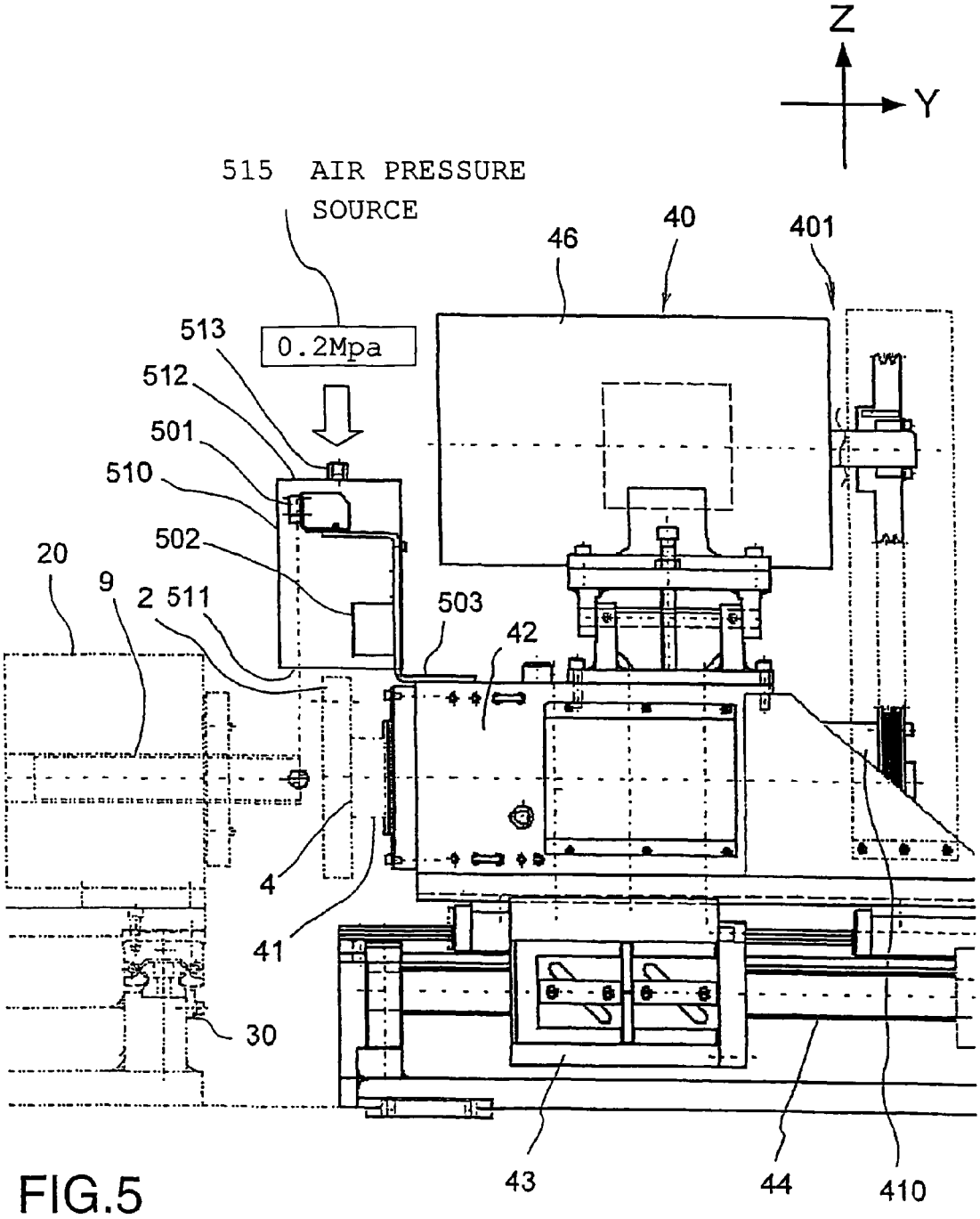
FIG. 5 is a sectional view of an air purge box.

The air purge box 510 is formed in a box shape surrounding the position sensor 501 and temperature sensor 502, and has an opening portion 511 that opens downward, and faces in a direction substantially perpendicular to the axial direction in which the heated die 4 is pressed against the work piece 9, as illustrated in FIG. 5, such that air passing through the opening portion 511 will flow in the direction substantially perpendicular to the axial direction. The opening portion 511 is positioned above the die 4 and the work piece 9 when the work piece 9 is in the processing position.

An air intake port 513 is provided in a ceiling portion 512 of the air purge box 510. The air pressure source 515 is connected to the air intake port 513 via a pipe, not shown in the figure. As shown by the outlined arrow in FIG. 5, air pressurized to approximately 0.2 Mpa, for example, is supplied to the air intake port 513 through the pipe.

A frame 503 bent into a crank shape is attached to an upper portion of the die support case 42, and the position sensor 501, temperature sensor 502, and air purge box 510 are attached respectively to the frame 503.

The position sensor 501 is attached to an upper end portion of the frame 503, while the temperature sensor 502 is attached to a midway point on the frame 503. The temperature sensor 502 is disposed beneath the position sensor 501 in the interior of the air purge box 510.

The closing machine 1 is constituted as described above, and next, an action thereof will be described.

During an operation of the closing machine 1, pressurized air is supplied to the air intake port 513 through the pipe such that the interior of the air purge box 510 is filled with the supplied air. The air then flows out to the exterior of the air purge box 510 through the opening portion 511, thereby suppressing infiltration of the lampblack that is generated from the processed portion of the work piece 9 into the air purge box 510. As a result, the detection portion of the position sensor 501 and temperature sensor 502 can be prevented from becoming soiled by the lampblack, and the detection precision of the position sensor 501 and temperature sensor 502 can be maintained at a high level.

The air purge box 510 comprises the opening portion 511 that opens downward, and therefore the interior of the air purge box 510 is filled with the supplied air such that the lampblack generated from the processed portion of the work piece 9 is effectively prevented from infiltrating the air purge box 510.

By providing the position sensor 501 for detecting the position of the work piece 9 and the temperature sensor 502 for detecting the temperature of the die 4 in the interior of the air purge box 510, and disposing the temperature sensor 502 beneath the position sensor 501, both the position sensor 501 and the temperature sensor 502 can be provided inside the single air purge box 510 within the limited space of the closing machine 1, thereby enabling structural simplification.

INDUSTRIAL APPLICABILITY

The closing method and closing machine of this invention are not limited to a closing operation such as that described above, for closing an open end of a work piece, and may be used in a spinning operation to reduce the diameter of a work piece by pressing a die against the rotating work piece.

The invention claimed is:

1. A closing machine for closing an open end of a work piece that rotates about an axial center thereof by pressing a heated die against the work piece, the axial center being in a first horizontal direction that is substantially perpendicular to the direction of gravity, comprising:

a chuck spindle that rotates the work piece;

a moving device that moves the chuck spindle, together with the work piece, along a second horizontal direction to a processing position in which the heated die is pressed against the work piece, the second horizontal direction being substantially perpendicular to the direction of gravity and being perpendicular to the first horizontal direction;

an air purge box disposed vertically above the processing position with respect to the direction of gravity and having an opening portion that opens vertically downwards towards the work piece in the processing position along the direction of gravity;

a sensor provided in the interior of the air purge box to detect a state of the work piece that has moved to the processing position; and air supply means for supplying air to an interior of the air purge box, so as to prevent the sensor from being exposed to lampblack generated by a processed portion of the work piece by the heated die.

2. The closing machine as defined in claim 1, wherein the sensor comprises a position sensor which detects a position of the work piece and a temperature sensor which is disposed beneath the position sensor with respect to the direction of gravity and detects a temperature of the die.

* * * * *